US009970738B2

(12) United States Patent
Garcia Gamon et al.

(10) Patent No.: US 9,970,738 B2
(45) Date of Patent: May 15, 2018

(54) PYROTECHNIC CARRIER STRUCTURE

(71) Applicants: Fernando Garcia Gamon, Valencia (ES); Manuel Garcia Gamon, Valencia (ES)

(72) Inventors: Fernando Garcia Gamon, Valencia (ES); Manuel Garcia Gamon, Valencia (ES); Antonio Manuel Garcia-Gamon Valero, Valencia (ES); Fernando Garcia-Gamon Anton, Valencia (ES); José María Martinez Jimenez, Valencia (ES)

( * ) Notice: Subject to any disclaimer, the term of this patent is extended or adjusted under 35 U.S.C. 154(b) by 0 days. days.

(21) Appl. No.: 15/309,243

(22) PCT Filed: May 14, 2015

(86) PCT No.: PCT/ES2015/070384
§ 371 (c)(1),
(2) Date: Nov. 7, 2016

(87) PCT Pub. No.: WO2015/173458
PCT Pub. Date: Nov. 19, 2015

(65) Prior Publication Data

US 2017/0067722 A1 Mar. 9, 2017

(30) Foreign Application Priority Data

May 15, 2014 (ES) ..... 201430711

(51) Int. Cl.
*F42B 4/20* (2006.01)
*F41A 23/54* (2006.01)

(52) U.S. Cl.
CPC ..... *F42B 4/20* (2013.01); *F41A 23/54* (2013.01)

(58) Field of Classification Search
CPC ..... F42B 4/00; F42B 4/10; F42B 4/14; F42B 4/20; F42B 4/22; F42B 4/24; F41A 23/54
USPC ..... 102/335, 361, 357, 358, 342, 343; 89/1.816, 1.41
See application file for complete search history.

(56) References Cited

U.S. PATENT DOCUMENTS 4,063,485 A * 12/1977 Carter ..... F41F 3/04 89/1.51
4,222,306 A * 9/1980 Maury ..... F42B 5/15 89/1.41
5,429,053 A * 7/1995 Walker ..... F42B 4/20 102/342
6,851,371 B1 * 2/2005 Wah ..... F42B 4/20 102/343

(Continued)

FOREIGN PATENT DOCUMENTS

CA 2770392 A1 * 4/2011 ..... F41A 9/63
CA 2770392 A1 * 4/2011 ..... F41A 9/63

(Continued)

*Primary Examiner* — John Cooper
(74) *Attorney, Agent, or Firm* — Luoh J. Wu; Continent Patent Office LLP

(57) ABSTRACT

The invention relates to a pyrotechnic carrier structure made from profiles (1) that can be interconnected on the edges thereof and with relative rotational freedom in order to form a firing base (20), to be horizontally arranged on the ground or warped for the arched arrangement thereof on support elements (12) formed by pairs of housings (13 and 14, 15 and 16, 17 and 18). Furthermore, the longitudinal movement of the profiles is avoided.

8 Claims, 3 Drawing Sheets

(56) References Cited

U.S. PATENT DOCUMENTS

| | | | | |
|---|---|---|---|---|
| 7,007,584 | B2 * | 3/2006 | Caballer Barat | F42B 3/26 102/343 |
| 7,562,627 | B2 * | 7/2009 | Voigt | F42B 4/24 102/217 |
| 8,966,830 | B2 * | 3/2015 | Trenkler | E05D 1/04 405/279 |
| 2010/0282228 | A1 * | 11/2010 | Al-Garni | F41B 11/681 124/59 |
| 2012/0247310 | A1 | 10/2012 | Klasen | |
| 2015/0176946 | A1 * | 6/2015 | Montgomery | F41F 1/06 89/1.816 |

FOREIGN PATENT DOCUMENTS

| | | | |
|---|---|---|---|
| FR | 2715998 | A1 | 8/1995 |
| JP | 2715998 | U1 | 2/1998 |

* cited by examiner

PYROTECHNIC CARRIER STRUCTURE

SCOPE OF THE INVENTION

The invention refers to a pyrotechnic carrier structure used for firing mortars containing fireworks.

BACKGROUND OF THE INVENTION

There are known pyrotechnic structures including firing bases formed by one or more pieces of thermoplastic material combined together and provided with housings that support the bases of the mortars containing the fireworks, so that they can be arranged at different angles. Typically, the housings are individual cavities open at the base and configured to receive the lower part of the pyrotechnic mortar. An example of this kind of firing bases is shown in document U.S. Pat. No. 5,429,053, in which an elongated body comprises a series of cavities that receive the bases of the mortars containing the fireworks. The support surface of the mortars is convex so that the mortars are placed at different angles.

U.S. Pat. No. 4,222,306 describes a staggered arrangement of mortars that pursues the same goal. Naturally, only tubes of the sane diameter can be coupled together. Additionally, the mortars are not retained by the firing base, and the bases need to be secured to the ground when pyrotechnics of a certain level of power and intensity are fired.

The fireworks mortar battery described in document ES 2330282 proves to be adequately stable with higher firepower; it is formed by a firing base manufactured by moulding plastics with a surface that comprises rails to secure the mortars, so that a plurality of mortars can be arranged in a line and retained by the rails. Subsequent embodiments feature pyrotechnic bases with a curved crosswise section and longitudinal rails for the mortars, which are also manufactured by moulding thermoplastic materials. In order to use them, the firing bases, which are heavier, are arranged with their edges resting on the ground supporting their weight, so that the lines of mortars retained by the rails are placed at different angles in relation to each other.

However, these last solutions described are extraordinarily rigid so that storing, transporting and using them is not only complex but also costly.

FR 2715998 discloses another system for launching several units, each of them equipped with a launch tube and provided with coupling elements on two opposite sides of the tube, which allow the bases to be joined together in order to form a unit and at the same time achieve a relative angular relationship between them, so that two launch tubes can be rotated between them. The tubes can be of different sizes. This system is also complex to manufacture, assemble and use, in addition to being extremely costly.

Other attempts have been made to reduce the size of these pyrotechnic structures. Thus, U.S. Pat. No. 6,851,371 describes a fireworks launching device comprising a support base on the ground that incorporates a mortar support structure and hinged wings that are folded when the device is transported, and unfolded when it is launched, which also comprise security mechanisms that prevent the wings from folding when the base is in use in order to ensure the safety of firing the device.

However, the inherent problems of incorporating mortars of the same or different diameters on a mortar support platform have not been addressed, and neither have the problems of positioning and holding the device in an adequate vertical position all along its length and width.

OBJECT OF THE INVENTION

Therefore, one of the objects of the invention is to provide a pyrotechnic carrier structure of a reduced size that improves firing fireworks. A further object of the invention is to provide a pyrotechnic carrier structure that comprises a firing base to support the mortars, comprising multiple combined profiles that can be easily, simply and quickly mounted and dismounted in order to provide multiple configuration options, and that can also be easily mounted on-site by the user. A further object of the invention is to provide a pyrotechnic carrier structure comprising a firing base made from combined profiles formed by rails that receive and retain lines of mortars. A still a further object of the invention is to provide a pyrotechnic carrier structure that improves the orientation and firing capabilities of pyrotechnic loads.

DESCRIPTION OF THE INVENTION

A pyrotechnic carrier structure that meets all the requisites mentioned above and that addresses the problems shown by conventional pyrotechnic structures is provided comprised of a firing base formed by multiple profiles arranged one alongside the other when the base is used. The pyrotechnic carrier structure comprises a base formed by at least one profile and preferably a plurality of profiles, of a number that can be increased depending on the needs of the user. The profiles can be manufactured, preferably made of aluminium or a different metal, extruded or laminated in conventional longitudinal bars, with profile widths arranged according to the needs of the user and cut at a workshop or at the place where they are fired, in predetermined lengths according to their use. The profiles have rails that extend longitudinally on at least one of their sides, typically the side opposite to the supporting surface, and a crosswise section modified to introduce the lateral extensions common in mortars containing pyrotechnic loads, so that the launch tubes or mortars can be inserted in the rails by sliding them in to form a line of mortars, for example at the place where they are fired. The mortars in the line are held in a vertical position in relation to the supporting surface of the firing base, and they are retained in the rails for firing.

In order to form the firing base, each of the profiles is provided with a first connecting member that is completely hollow and open longitudinally by an axial slot, which extends along the length of a first rim or first longitudinal edge of the central part of the profile, and with a second connecting member, hollow or solid but modified to slide along the length of the first connecting member and preferably corresponding each other, which extends along the length of a second rim or second longitudinal edge of the central part of the profile, so that the profiles that comprise the firing base can be connected together by inserting the second connecting member of a profile in the first connecting member of an adjacent profile. Advantageously, the profiles can be provided with safety firing distances, and/or predetermined widths for the rails and/or for the intermediate longitudinal edges between the rails and the connectors. Accordingly, the firing base can be comprised of, for example, profiles with rails of different widths in order to be able to combine them in a same—pyrotechnic launch of mortars of different diameters.

The firing base can be provided so that it can be fired when it is horizontally arranged on the ground or warped for the arched arrangement thereof on at least one support element, and also though less often, warped in the form of a prism to be supported for firing. In a first arrangement, the firing base just needs to be placed on the ground or another solid horizontal surface in order to be able to fire the pyrotechnic loads in the mortars, though in this arrangement the mortars are placed vertically and they are fired skyward. In order to be used in the arched arrangement, the firing base must be warped and the profiles need to be connected in an articulated way in order to allow for a small angular movement between some in relation to others, making it possible for each of the lines of pyrotechnic mortar tubes to have different orientations. Therefore, it is necessary that the profiles on the firing base have a relative rotational freedom in relation to their adjacent profiles, for example, between 3° and 30°, preferably between 12° and 18° in some embodiments. In consequence, the opening or separation of the walls of the axial slot in the first connecting member is made of a higher width than the thickness of the core of the profile, allowing and limiting the rotation of a profile in relation to its adjacent one. Said slot has an outlet angled at between 3° and 30°, preferably close to 15 degrees.

With the aim of avoiding the longitudinal movement of the profiles on the firing base, the profiles comprising the firing base of the pyrotechnic carrier structure have recesses on the surface of at least one of the sides of each profile, for example, on the side facing the support of the structure, which are operational for coupling the two adjacent profiles together. Said surface recesses are preferably formed at least on the first connecting member of the profiles, and they are adapted to collaborate with independent retaining elements connected to the adjacent profiles, for example, connected separately to a centred part along the width of the profile.

When the pyrotechnic carrier structure needs to be arranged in an arched firing position, the firing base must be subsequently warped and tensed by mounting it on at least one support element, wherein each one of the profiles comprising the firing base is aimed at a predetermined angle different from their adjacent profile, and the lines of mortar tubes are oriented normal to the corresponding orientation of the profiles carrying them. The support element is comprised of at least one pair of housings separated between them and that extend downwards, thus being enough if their respective slots were provided, separated at a convenient distance between them in the support element, and adapted to be able to receive at least or part of the lateral sides of the base, for example, by inserting them in the slots. In order to better adjust, retain and hold in place the firing base, the housings preferably comprise their respective geometric axes at opposing angles, and they are configured to be able to slide and insert in them the respective lateral end parts of the mortar carrier base.

Since the assembly is modular, the support element is preferably comprised of a plurality of pairs of housings contained in each other, and the angle of their geometric axes with different orientations increases and tends to the vertical line towards the outer housings; the housings of each pair are separated from each other longitudinally with their respective geometric axis angled in opposition and formed in correspondence with the general sections of said respective first and second connecting members on the outer lateral parts of the mortar carrier base, and the slots are adapted to the width of the core of the profiles.

According to the above, it is evident that the profiles that have been custom-cut or not, the support elements, searing pins, mortars and, if applicable, the pyrotechnic loads for the mortars that comprise the pyrotechnic carrier structure can be stored and transported separately and mounted at the place where they are used, taking up minimum storing and transportation volume, and additionally the structure can be mounted or dismounted in any of its usage configurations in a simple, quick and cheap way. It is also evident that the pyrotechnic carrier structures can be easily adapted to the needs of the user since the varying number of profiles used to assemble them or their varying lengths and widths predetermine the number of mortars used in the horizontal or the skyward firing arrangement of the structure, and therefore its firing capability. When the device needs to be used in the arched arrangement, the longitudinal variations between the housings comprising each of the pairs of housings of the support element or elements of the pyrotechnic carrier structure will determine the number of profiles connected between them, and/or their width, in the configuration of the firing base incorporated in said support elements.

BRIEF DESCRIPTION OF THE DRAWINGS

One exemplary embodiment, which is not limiting, of a pyrotechnic carrier structure is shown in the drawings included, in which the pyrotechnic mortars and other alternative or secondary elements have not been represented in order to display the drawings more clearly. In the drawings.

PREFERRED EMBODIMENT OF THE INVENTION

Figure 1:
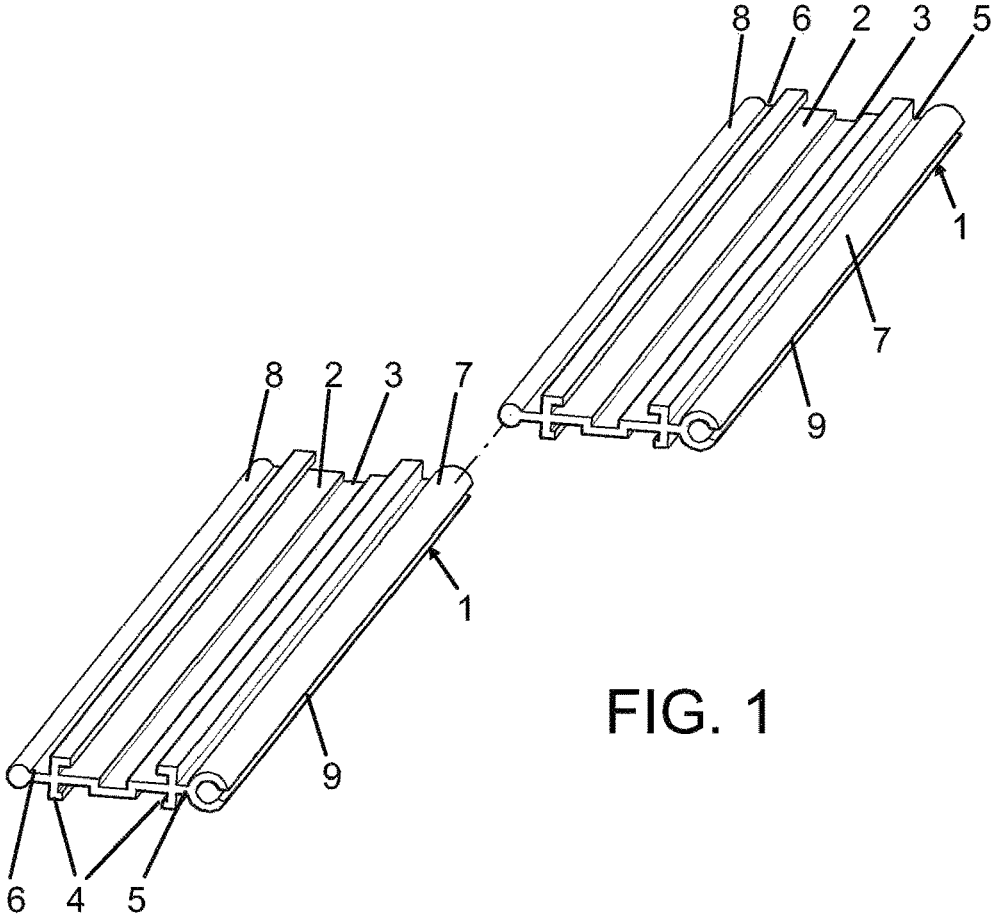
FIG. 1 shows a top perspective view before two adjacent profiles are connected, in accordance with an embodiment of the invention.

In the embodiment described and referencing the drawings, a pyrotechnic carrier structure is comprised by profiles 1 arranged so that they can be connected one next to the other as shown on FIG. 1 in order to form a carrier base 20 for the mortars 21 containing the fireworks at the moment they are fired. Referencing FIG. 1, each profile 1 has a rail 2 running along its length configured to receive and retain the base of the mortars, and this rail is centred longitudinally on the firing side and in a part 3 of the profile 1, whereas the side of the profile 1 that rests on or faces the ground comprises reinforcing ribs 4 to withstand the effects of firing the pyrotechnic mortars. The first connecting member 7 extends along the length of a first longitudinal edge 5 of the part 3 of each profile 1; it is completely hollow and is longitudinally open all along the length thereof by means of an axial slot 9. The second longitudinal edge 6 of said part 3 of each profile 1 extends longitudinally by means of the second connecting member 8, which can be seen in the example as comprising a section that corresponds with and is adjusted to the first connecting member 7, though that is also smaller.

Figure 2:
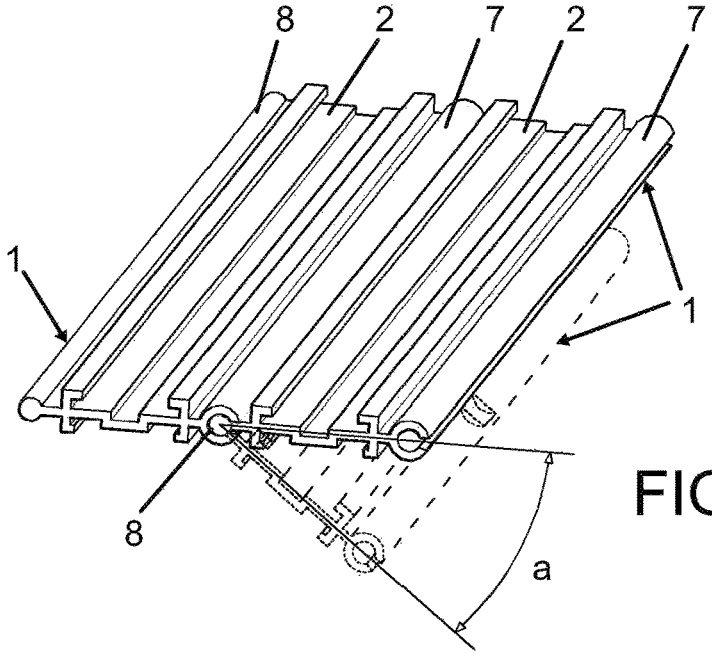
FIG. 2 is a perspective view of the combination of two adjacent profiles in correspondence with FIG. 1, which are horizontally arranged and also show how much they can rotate in relation to each another.

As can be easily observed, FIG. 2 shows more clearly the rotational freedom determined by the angle (a) shown by two profiles 1 once they have been connected together after inserting and sliding the second connecting member 8 of a profile 1 in the corresponding first connecting member 7 of an adjacent profile 1, and after being rotated.

Figure 3:
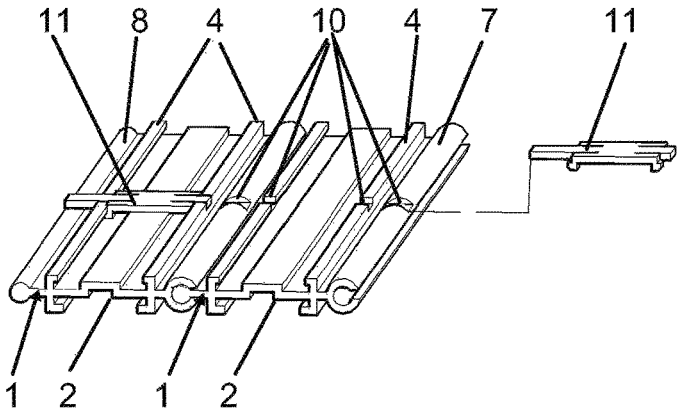
FIG. 3 is a bottom perspective view at a different scale of the combination of two profiles according to FIG. 2, showing the recesses made on the lower side of the profiles and the initial and final arrangements of the respective searing pins.

FIG. 3 shows more clearly the connection between two horizontally arranged profiles 1, and it also displays the surface recesses 10 made transversally on the supporting side of each of the profiles 1, which in the example extend to the first connecting number 7 and equally extend to the reinforcing ribs 4 of each of the profiles 1. The surface recesses 10 collaborate with the central longitudinal tabs in the searing pins 11, which are connected and can be dismounted in both profiles 1, and inserted either by sliding or snap-fitting them between the reinforcing ribs 4 next to the recesses 10, so that the tabs of the searing pins 11 fit on the recesses 10, typically in order to prevent the longitudinal movement between both profiles 1.

Figure 4:
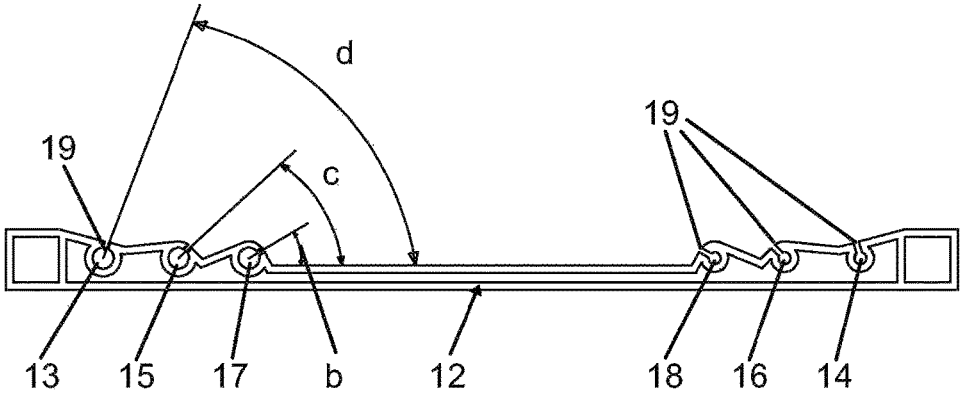
FIG. 4 is an elevation view at a different scale of a support element of the pyrotechnic carrier structure.

An example of a support element 12 of the pyrotechnic carrier structure 20 of the mortars 21 is shown on FIG. 4 independent from the pyrotechnic carrier structure, which shows the configuration and arrangement of the housings 13, 15, 17 and 14, 16, 18, in addition to the inclination of their respective geometric axes (b, c, d) in relation to the slots 19.

Figure 5:
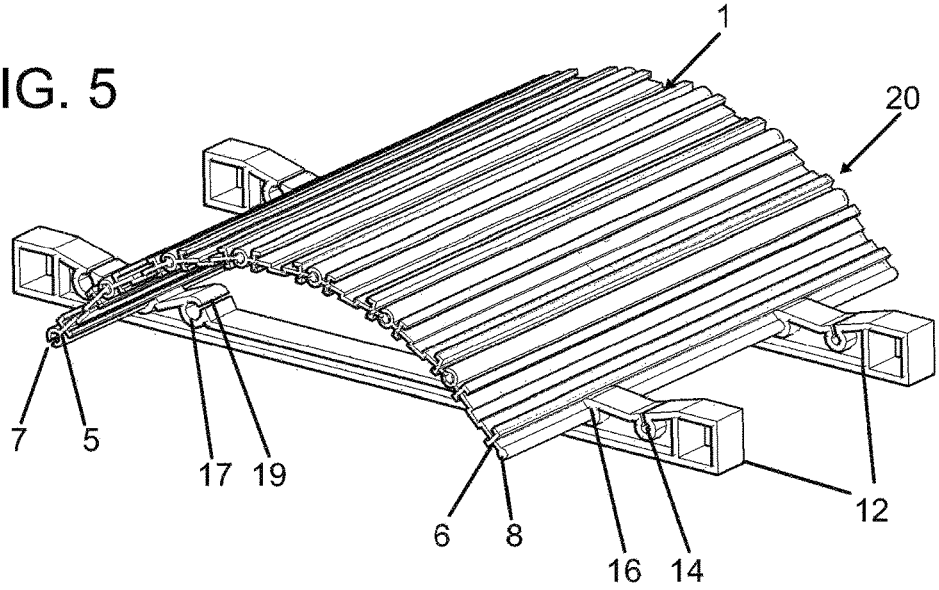
FIG. 5 is a perspective view at a different scale of a firing base with a determined number of combined profiles in arched arrangement and located between the middle pair of housings of two support elements, which determines the structure in place before the pyrotechnic mortars are added.
Figure 6:
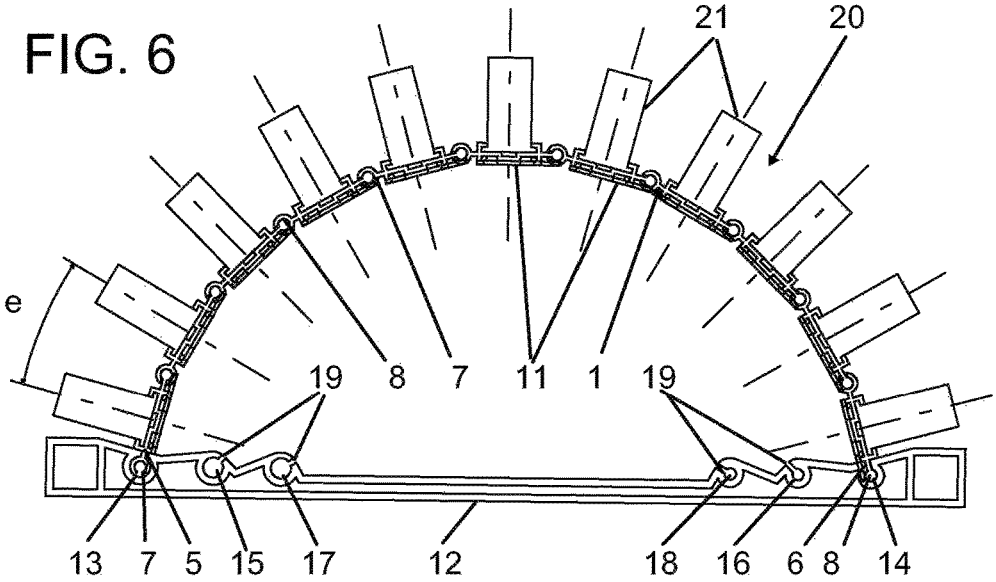
FIG. 6 is an elevation view at a different scale of a firing base similar and alternative to the one shown on FIG. 5, though with a higher number of combined profiles, in arched arrangement and located between the outer pair of housings of the support elements, showing the pyrotechnic mortars being added, which are at the head of each line of mortars in the rails of the pyrotechnic carrier structure.

The pyrotechnic carrier structure comprises a base 20 comprised of a plurality of profiles 1 as shown on FIG. 5, though comprising a larger number of profiles on FIG. 6. Referencing the drawings, the base 20, which is formed by profiles 1 connected together after their respective second connecting members 8 have been inserted and slid in the corresponding first connecting members 7 of the adjacent profiles, is shown warped and mounted after the outer end parts thereof have been inserted in the pair of housings 15 and 16, which are longitudinally separated in the support elements 12, or vice versa, as shown on FIG. 5; or in the pair of housings 13 and 14 as shown on FIG. 6. In the example provided, the first lateral part of the base 20 is formed by the first longitudinal edge 5 and the first connecting member 7 of an outer profile in one of the sides of the base 20, and the second lateral part is formed by the second longitudinal edge 6 and the second connecting member 8 of the outer profile in the opposite side of the base 20. Optionally and although it has not been shown in the drawings, the base 20 of the pyrotechnic carrier structure could be horizontally arranged on a support surface, without having to use the support elements 12.

As shown in the examples of the structures shown on FIGS. 5 and 6, each one of the housings 13, 14, 15, 16, 17 and 18 extends downwards towards the support elements 12 from an upper slot 19 of a narrow width that is, however, wider than the thickness of the part 3 of the profiles 1. It can also be observed that the housings of each pair of housings 13 and 14, 15 and 16, 17 and 18 in the support elements 12 are separated from each other. The pairs of housings are shown contained in each other, and the inclination of the geometric axes of the housings 13, 15 and 17 are shown in opposition to the orientation of the housings 14, 16 and 18. Each pair of housings is shown with a different orientation that increases and tends to the vertical line towards the outer sides of the support elements 12. Likewise, it can be observed that the design of each housing is adapted for inserting and sliding the respective general sections of the outer lateral parts, 5 and 7, 6 and 8 respectively, of the mortar carrier base 20, so that each of the profiles 1 that form the base 20 are oriented at a predetermined and different angle in relation to each adjacent profile 1, and the lines of mortar tubes, which are shown on FIG. 6 by means of the mortar 21 that is further ahead, are oriented normal to the corresponding orientation of the profiles 1, with (e) describing the angular distance between them.

The invention has been described pursuant to the shown embodiments. It becomes obvious that it is possible to contribute modifying details and/or replace specific elements or devices for other equivalent ones or add supplementary devices of the known type without abandoning the scope of the invention.

The invention claimed is:

1. A PYROTECHNIC CARRIER STRUCTURE comprising:

a carrier base (20) for retaining mortars containing fireworks that are going to be fired, said base (20) being comprised of profiles (1) arranged one alongside the other to form the base (20), and each profile (1) includes a first rim or first longitudinal edge (5), a second longitudinal edge (6) and at least one rail (2) that extends longitudinally in one part (3) of the profile (1) for retaining mortars;

wherein each of said profiles (1) comprises at least one hollow connecting member (7) that is longitudinally open by an axial slot (9), the slot (9) extending along a length of a first rim or first longitudinal edge (5) of a central part (3) of the profile (1), and a second connecting member (8) shaped and adapted completely to slide in said first connecting member (7), the second connecting member (8) extending along a length of the second longitudinal edge (6) of said part (3) of the profile (1), so that adjacent profiles (1) can be connected together by inserting the second connecting member (8) of the first profile (1) in the first connecting member (7) of an adjacent second profile (1), wherein said base (20) is configured to be warped to provide an arched arrangement thereof mounted on at least one support element (12).

2. The PYROTECHNIC CARRIER STRUCTURE according to claim 1, wherein the connection between said first connecting member (7) of the first profile (1) and said second connecting member (8) of an adjacent second profile (1) permits a rotational freedom of movement between the first and the second profiles, wherein the profiles (1) have a relative rotational freedom (a) between 3° and 30°, limited by the walls of said axial slot (9).

3. The PYROTECHNIC CARRIER STRUCTURE according to claim 2, wherein the rotational freedom (a) is between 12° and 18°.

4. The PYROTECHNIC CARRIER STRUCTURE according to claim 1, wherein said carrier base (20) for mortars comprises surface recesses (10) on at least one of the sides of each profile (1), which are operational for coupling two adjacent profiles (1), and said surface recesses (10) are present on at least said first connecting member (7) of each profile (1) to collaborate with a searing pin (11) which is connected to and can be dismounted from the part (3) of the adjacent profile (1), in order to prevent longitudinal relative movement of the profiles (1).

5. The PYROTECHNIC CARRIER STRUCTURE according to claim 1, wherein when said carrier base (20) is warped it is arranged to have an arched firing arrangement, and the profiles (1) are mounted on the at least one support element (12), so that each of the profiles (1) is oriented at a predetermined and different angle relative to the ground in relation to the adjacent profile (1), and the lines of mortars (21) are oriented normal to the corresponding orientation of the profiles (1) carrying them.

6. The PYROTECHNIC CARRIER STRUCTURE according to claim 1, wherein the at least one support element (12) is comprised of at least one pair of housings (13 and 14, or 15 and 16, or 17 and 18), separated from one another, each of which extends downwards from respective upper slot (19), and that are configured to be able to have inserted and slid within them the hollow connecting member (7) and the second connecting member (8), of the carrier base (20) for mortars (21).

7. The PYROTECHNIC CARRIER STRUCTURE according to claim 6, wherein the at least one support element (12) is comprised of a plurality of the pairs of housings (13 and 14, 15 and 16, 17 and 18), the housings of each pair being longitudinally separated from one another with their respective geometric axes angled in opposition, the pairs of housings being contained in each other and the angle of the geometric axes of the pairs of housings having different orientation, increasing and tending to the vertical line towards the outer sides of the support element (12).

8. The PYROTECHNIC CARRIER STRUCTURE according to claim 7, wherein the pairs of housings (13 and 14, 15 and 16, 17 and 18) are respectively formed in correspondence with the general sections of said first (7) and second (8) connecting members respectively on the outer lateral parts of the carrier base for mortars, and the slots (19) are adapted to the width of the part (3) of the profiles (1).

* * * * *